United States Patent [19]

Engmann et al.

[11] Patent Number: 4,483,490

[45] Date of Patent: Nov. 20, 1984

[54] INDIVIDUAL COIL WINDER WITH AUTOMATIC COIL CHANGE

[75] Inventors: Günther Engmann; Werner Hagen, both of Schwabach; Hermann Heider, Kammerstein, all of Fed. Rep. of Germany

[73] Assignee: Maschinenfabrik Niehoff KG, Schwabach, Fed. Rep. of Germany

[21] Appl. No.: 484,426

[22] Filed: Apr. 12, 1983

[30] Foreign Application Priority Data

Apr. 27, 1982 [DE] Fed. Rep. of Germany ..... 3215573

[51] Int. Cl.[3] ..... B65H 54/02; B65H 75/28

[52] U.S. Cl. ..... 242/25 R; 242/18 PW; 242/25 A

[58] Field of Search ..... 242/25 R, 25 A, 18 PW, 242/18 A, 56 R, 56 A

[56] References Cited

U.S. PATENT DOCUMENTS

| | | | |
|---|---|---|---|
| 3,441,229 | 4/1969 | Henrich | 242/25 A |
| 3,592,399 | 7/1971 | Woodrow | 242/25 R |
| 3,596,844 | 8/1971 | Engmann | 242/25 A |
| 3,620,482 | 11/1971 | Bravin | 242/25 A |
| 3,876,161 | 4/1975 | Miller | 242/18 PW X |
| 3,908,918 | 9/1975 | Bergstrom | 242/18 PW X |
| 3,994,058 | 11/1976 | Sasaki et al. | 242/25 R X |
| 4,019,543 | 4/1977 | Sasaki et al. | 242/25 R X |
| 4,026,483 | 5/1977 | Skalleberg | 242/25 R |
| 4,098,467 | 7/1978 | Engmann et al. | 242/25 A |
| 4,239,187 | 12/1980 | Boggs | 242/25 R |
| 4,292,114 | 9/1981 | Engmann et al. | 242/25 R X |

*Primary Examiner*—Stanley N. Gilreath
*Attorney, Agent, or Firm*—Kenyon & Kenyon

[57] ABSTRACT

A wire manipulator at an individual coil winder has an arm pivotably and slidably attached to a support column itself slidable along a path parallel to a wire segment extending from a winding station to a fully wound spool at a coil changing station upon termination of a winding operation. A clamping head at the free end of the manipulator arm is provided with a wire severing device in the form of a cutting edge, an electrical circuit or a small torch.

19 Claims, 18 Drawing Figures

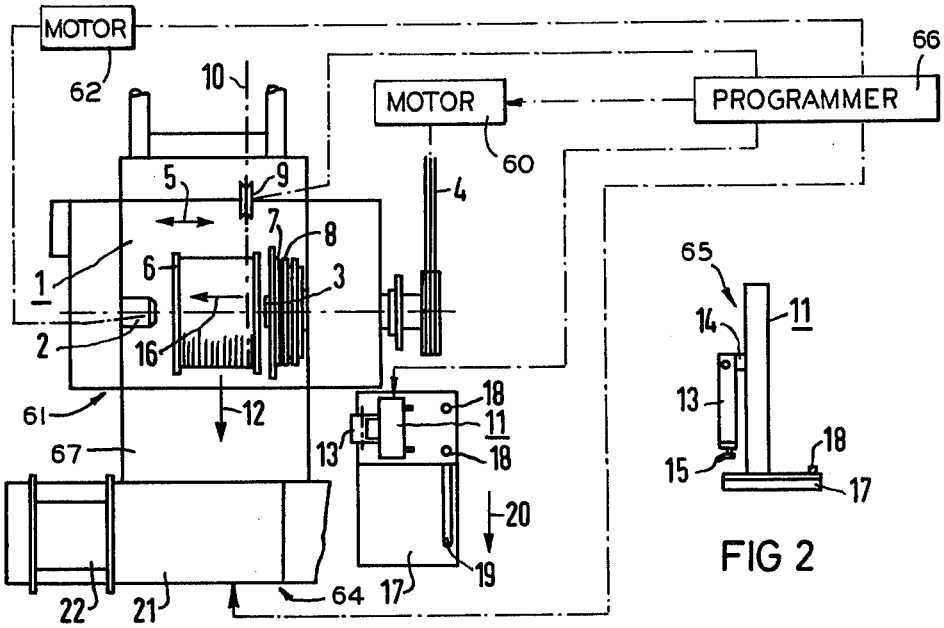
FIG 1
FIG 2
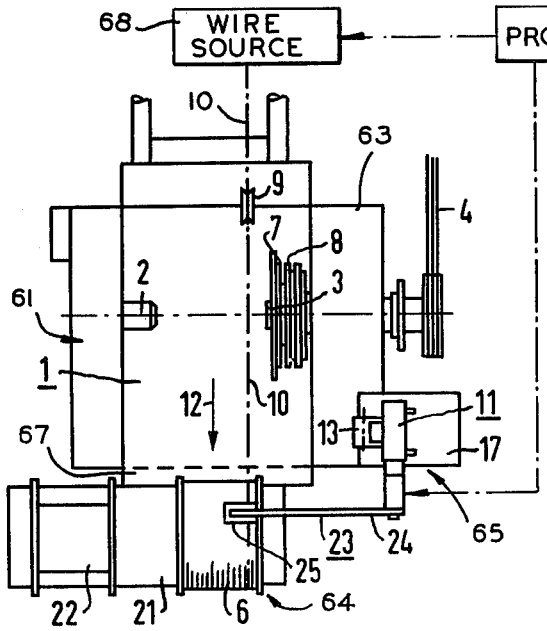
FIG 3
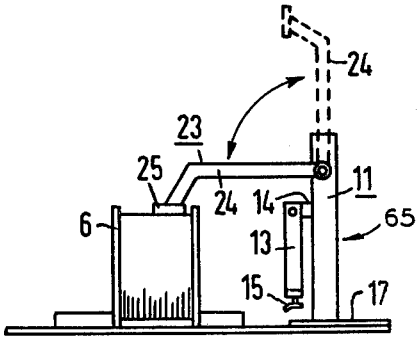
FIG 4

INDIVIDUAL COIL WINDER WITH AUTOMATIC COIL CHANGE

BACKGROUND OF THE INVENTION

This invention relates to an individual coil winder with automatic coil change for winding string-like material, especially wire.

Individual coil winders of this type are described in U.S. Pat. No. 4,292,114 and have found acceptance in practice. It has been discovered, however, that a retrofit installation of the wire manipulator disclosed in that application into already existing winding machines can be carried out only at great expense. Furthermore, difficulties arise in the case of rigid and less flexible wires with respect to wire deflections.

An object of the present invention is to provide an individual coil winder of simple and clear-cut design with a manipulator mountable to existing winders and adjustable to minimize deflection points for the wire, whereby rigid or relatively stiff wires can be wound up substantially more readily. An additional object of this invention is to provide such a coil winder in which both winding ends of a completed wire coil are undamaged and sufficiently long so that these coil ends can be welded to other ends to form a string as long as possible without the need for a separate auxiliary coil in the individual coil winder for preparing the long wire ends. Yet another object of this invention is to provide such a coil winder in which the winding and coil changing operation is full automatic, even for relatively high coil weights.

SUMMARY OF THE INVENTION

An individual coil winder for winding a string-like material such as wire on a coil form or spool having a pair of lateral flanges is provided, in accordance with the present invention, with a wire manipulator comprising a support post spaced from a winding station, an arm pivotably and slidably fastened to the support post, and a device on the arm for grasping and severing the wire (or other string-like material) at a point along a segment of the wire extending from the winding station to a fully wound coil form upon removal thereof from the winding station at the termination of a winding operation. Such a manipulator is particularly capable of inserting a wire end segment, formed by the severing process, into a closable clamping gap at the winding station. The gap is sufficiently spaced from the position taken by coil form at the winding station to ensure that the leading wire segment of a coil projects or dangles therefrom to enable welding of the coil to other coils.

In accordance with another feature of the present invention, the manipulator includes either a cutting edge or a heat generating device such as a small torch or an electrical circuit. Severing a wire by heat energy is especially effective in producing weldable wire ends.

In accordance with further features of this invention, the manipulator is removably mounted to a winder support frame at a point between the winding station and a coil changing station. The manipulator is advantageously slidably secured to a base for motion parallel to the wire segment extending from the winding station to a fully wound coil form at the coil changing station upon transfer of the coil form at the termination of a winding operation. Other features of the present invention include the provision of means for accommodating the relatively rapid draw of wire during a coil transfer operation.

An individual coil winder according to this invention is distinguished from known devices particularly in that, due to the physical separation of the manipulator from the individual coil winder, the cutting, clamping and securing devices for the wire are arranged in a more clean cut manner and are also more readily accessible for servicing. In addition, relatively thick and less flexible wires can be wound with this device using less power, since there are practically no deflection points for the wire.

BRIEF DESCRIPTION OF THE DRAWINGS

FIG. 1 is a top view of an individual coil winder according to the present invention, showing a separately disposed wire manipulator, a fully wound coil form and a disengaged tailstock.

FIG. 2 is a front view of the manipulator shown in FIG. 1.

FIG. 3 is a top view of the coil winder of FIG. 1, illustrating a pivotable wire securing device and a conveyor carrying an empty spool and a fully wound spool.

FIG. 4 is a front view of the wire securing device of FIG. 3 in an operating position and the manipulator of FIGS. 1–3 in a neutral or non-operating position.

DETAILED DESCRIPTION

Figure 5:
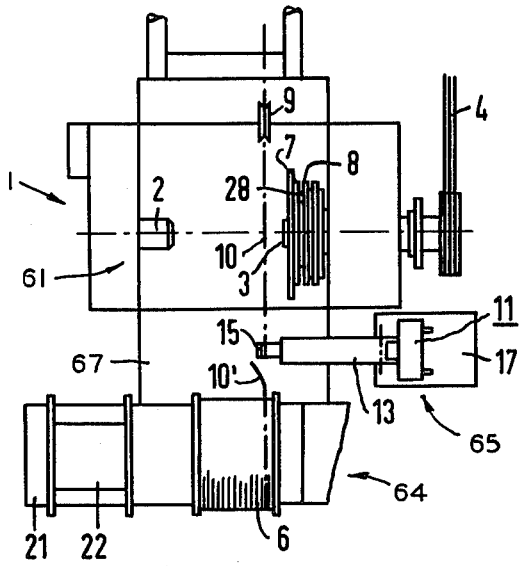
FIG. 5 is a top view of the coil winder and the wire manipulator of FIGS. 1 and 3, showing the manipulator at a first operating stage or position.

An individual coil winder 1 comprises, at a winding station 61, an axially movable tailstock 2 and an axially stationary but rotatable counter stock 3 in the form of a drive shaft which is driven via V-belts 4 or other driving means by a motor 60. The movable tailstock 2 is reciprocatable in the direction of double arrow 5 by a motor 62, whereby upon a shifting of the tailstock to the right in FIG. 1, a coil form or spool 6 and a pair of clamping discs 7 and 8 disposed laterally thereof at winding station 61 are pressed together and, upon a shifting of the tailstock 2 in the opposite direction, are disengaged. FIG. 1 shows a disengaged tailstock 2 and a fully wound spool 6 at the termination of a winding operation.

A laying roller 9 guides wire 10 (or other string-like material) onto spool 6 in a manner known per se. A wire manipulator 65 is disposed laterally of the path or track 12 along which a loaded spool 6 rolls upon disengagement of tailstock 2 at the termination of a winding operation. The manipulator may form a structural unit with the individual coil winder 1. As shown in FIG. 3, it may be fixed to a support frame 63 of winder 1. However, it may be alternatively arranged as a separate structural unit either stationary or movable parallel to a wire segment 10′ (see FIG. 3) forming part of wire 10 and extending from winding station 61 to a coil changing station 64 to which spool 6 moves upon becoming filled with wire 10.

As shown in FIG. 2, manipulator 65 comprises an arm 13 pivotably attached to a crosspiece 14 in turn slidably secured to a vertical support post or column 11. Manipulator 65, as well as motors 61 and 62, wire-laying roller 9 and a conveyor belt or transporter 21 at coil changing station 64, is controlled by a programmer 66.

The swingable arm 13 of manipulator 65 is provided at its free end with a holding and cutting head 15 for grasping and severing wire 10 at a point along wire segment 10′ (FIG. 3) upon the termination of a winding operation and the subsequent removal of a fully wound spool 6 from winding station 61 to coil changing station 64. In FIGS. 1 and 2 manipulator arm 13 is shown in a neutral or deactuated position assumed prior to the termination of the winding phase of an operating cycle of the coil winding apparatus, i.e., prior to a withdrawal stroke of tailstock 2. Upon the withdrawal or disengagement of tailstock 2, the fully wound spool 6 is shifted away from counter stock 3 in a slight lateral motion in the direction of arrow 16, the shifting being accomplished, for example, by non-illustrated compression springs.

As shown in FIGS. 1 and 2, manipulator 65 is slidably fastened to a base plate 17 by means of screws 18*a* and 18*b* traversing an elongated slot 19 in the plate. The distance of manipulator 65 from coil winding station 61 can be adjusted by moving the manipulator along slot 19 in the direction of arrow 20. It is to be noted that in all cases manipulator 65 is spaced from winding station 61.

Upon the withdrawal of tailstock 2 and the subsequent disengagement of the fully wound spool 6 from counterstock 3, the spool rolls in the direction of arrow 12 down a path or ramp 67 to conveyor belt 21 at coil changing station 64. As shown in FIGS. 3 and 4, manipulator 65 may include a fastening device 23 functioning at least in part to clamp wire 10 to the coil on spool 6 upon the attainment of the coil changing station thereby. Fastener 23 comprises a swivel arm 24 pivotably attached to support post 11 and provided at its free end with a supplying and dispensing device 25 for applying adhesive strips (not shown) to the coil on spool 6, thereby temporarily fastening to the coil a tail segment 10″ of wire 10 (see FIGS. 5 and 7) formed upon a severing thereof by device 15. Programmer 66 is operatively connected to fastener 23 for controlling the movement of arm 24 from a neutral position, shown in dashed lines in FIG. 4, to an actuated position, shown in solid lines. Fastener 23 is actuated upon the reaching of coil changing station 64 by fully wound spool 6 and is deactuated upon the application of an adhesive or other fastening to the coil on spool 6 and the severing of the wire 10 extending from spool 6 over wire-laying roller 9 to a wire supply or source 68 in the form of a wire drawing machine. Instead of being mounted to manipulator 65, fastener 23 may be provided as a separate structural unit. Moreover, fastener 23 may incorporate a telescoping member (not illustrated) as an alternative to swivel arm 24.

Figure 6:
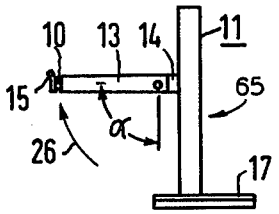
FIG. 6 is a front view of the manipulator in the operating stage shown in FIG. 5.

FIGS. 5 and 6 show manipulator arm 13 at a first operating stage or position reached upon a pivoting of the arm in the direction of arrow 26 through an angle of approximately 90°. Upon the attainment of the arm orientation shown in FIGS. 5 and 6, programmer 66 (FIG. 1) operates holding and cutting head 15 to clamp and sever wire segment 10′ (see FIG. 3), thereby forming wire tail segment 10″ (FIGS. 5 and 7) which is fastened to the coil on spool 6 by holding device 23 (FIGS. 3 and 4).

Figure 7:
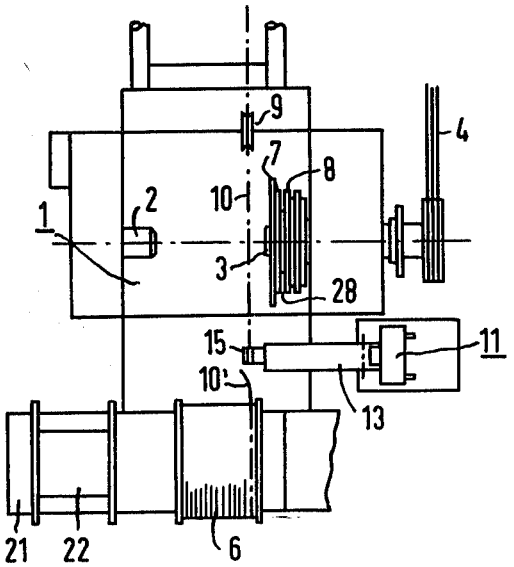
FIG. 7 is a top view similar to FIG. 5, illustrating the manipulator at a second operating stage.
Figure 8:
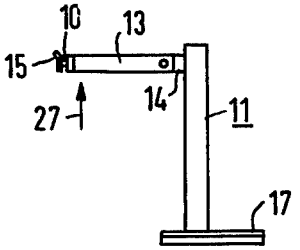
FIG. 8 is a front view of the manipulator at the operating stage illustrated in FIG. 7.
Figure 10:
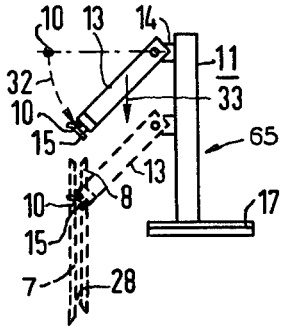
FIG. 10 is a front view, similar to FIGS. 2, 6 and 8, of the manipulator at the operating stage shown in FIG. 9.
Figure 11:
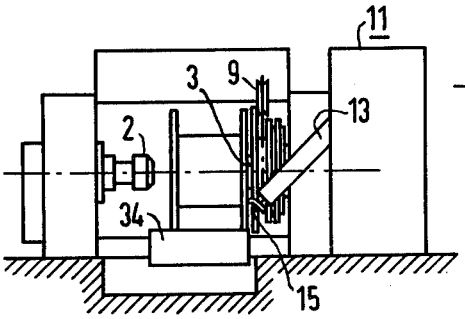
FIG. 11 is a front view of the coil winder of FIGS. 1, 3, 5, 7 and 9, showing a spool lift or table and the manipulator at a fourth operating stage.
Figure 13:
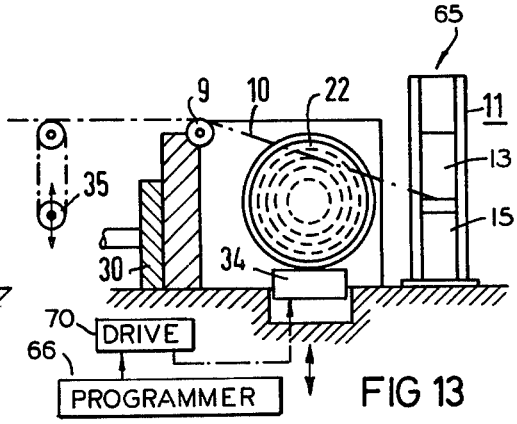
FIG. 13 is cross-sectional view taken along line XIII—XIII in FIG. 12.
Figure 12:
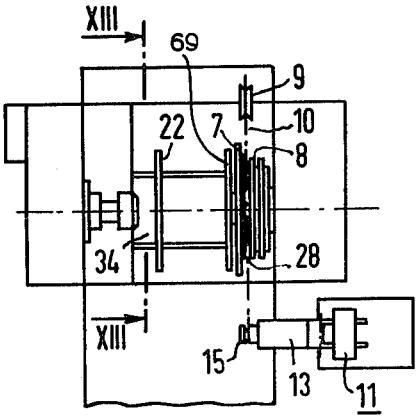
FIG. 12 is a top view corresponding to FIG. 11.

Upon the severing of the wire by holding and cutting head 15, manipulator arm 13, together with a leading segment of wire 10 held by head 23, is raised (arrow 27) under the control of programmer 66 to the position illustrated in FIGS. 7 and 8. Arm 13 is then pivoted in the direction of dashed arrow 32 through an acute angle to the position shown in solid lines in FIG. 10. Following this downward pivoting is a downward sliding of arm 13 (arrow 33) to the position shown in dashed lines in FIG. 10. Wire 10 then extends at an angle from wire laying roller 9 to severing head 15 and partially traverses a closable clamping gap 28 between clamping discs 7 and 8, as illustrated in FIGS. 11, 12 and 13.

Figure 9:
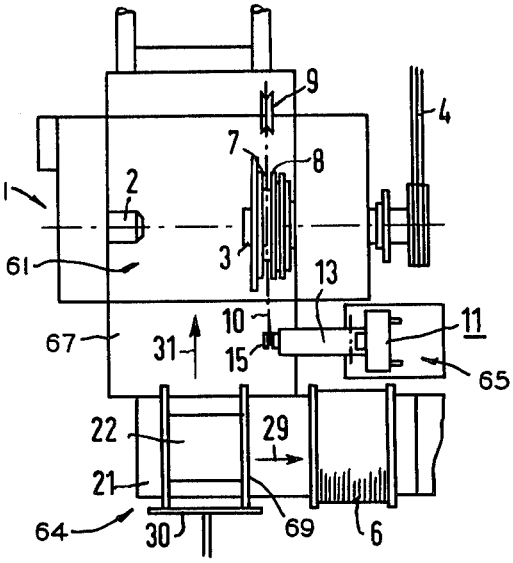
FIG. 9 is a top view similar to FIGS. 1, 3, 5 and 7, showing the conveyor in a shifted position relative to that illustrated in FIG. 3 and showing the manipulator at a third operating stage.

After the severing of wire 10 by holding and cutting head 15 and the return of fastener arm 24 to its deactuated position (see FIG. 4), programmer 66 operates a non-illustrated drive to move conveyor belt 21 in the direction of arrow 29 (FIG. 9), thereby substituting an empty spool 22 for the fully wound spool 6 at coil changing station 64. Upon the arrival of empty spool 22 at coil changing station 64 and the downward pivoting of manipulator arm 13 (FIG. 10), a pusher 30 at coil changing station 64 is shifted in the direction of arrow 31 (FIG. 9) by a non-illustrated drive such as a hydraulic cylinder under the control of programmer 66, whereby the empty spool is pushed off conveyor belt 21 and up ramp 67 to winding station 61.

As illustrated in FIGS. 11–14, the coil winding apparatus is advantageously equipped with a vertically translatable platform or table 34. Under the control of programmer 66, table 34 is raised by a reversible drive 70 (see FIG. 13) from a deactuated or neutral position, shown in FIG. 14, upon the arrival of empty spool 22 at winding station 61. The table is raised by such an amount that empty spool 22 is coaxial with tailstock 2 and counterstock 3. After the centering of spool 22, motor 62 (see FIG. 1) is actuated by programmer 66 to shift tailstock 2 axially and thereby clamp spool 22 against counter stock 3. The engagement of tailstock 2 with spool 22 also results in the closing of gap 28 (see FIG. 10) and the gripping of the leading end segment of wire 10 by clamping discs 7 and 8. Clamping disc 7 may be omitted from the coil winder, a lateral flange 69 of spool 22 coacting with disc 8 to clamp the leading end segment of wire 10.

It is to be noted that table 34 facilitates the winding, in any predetermined sequence, of wire 10 about coil forms or spools having different flange diameters. The successive winding of wire 10 about variously sized spools may be alternatively enabled by the use of a gripper-like automatically controlled robot (not illustrated) instead of conveyor belt 21 for effecting a change of spools between successive winding operations.

Figure 14:
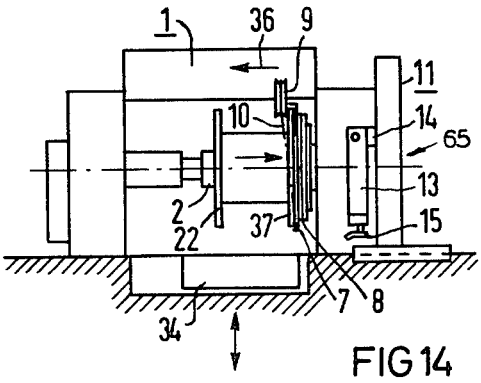
FIG. 14 is a front view similar to FIG. 11, showing the tailstock in an engaged position and the spool lift in a lowered position.

Upon the clamping of the empty spool 22 by tailstock 2 and counterstock 3 and the gripping of the leading end segment of wire 10 by clamping discs 7 and 8, platform 34 is lowered to its waiting or neutral position, wire 10 is released by holding and cutting head 15, and manipulator arm 15 is returned to its neutral position, as illustrated in FIG. 14. Programmer 66 then induces motor 60 to begin the rotation of counter stock 3 via belt 4, thereby commencing a winding operation, and operates wire-laying roller 9 to move in the direction of arrow 36, thereby initiating a first sweep of the roller in a winding operation.

As shown in FIG. 13, a wire accumulator 71 with a stationary roller 72 and a vertically shiftable compensation roller 35 is provided for temporarily storing a length of wire 10 to accommodate a relatively rapid draw of the wire upon the removal of a fully wound spool from winding station 61 to coil changing station 64 at the termination of a winding operation. The provision of accumulator 71 is particularly advantageous if the fully wound spool must travel a relatively long rolling distance down ramp 67. As an alternative to accumulator 71, wire drawing machine 68 (FIG. 3) may be controlled by programmer 66 to operate in an accelerated mode, e.g. an inching mode, during the movement of the fully wound spool from winding station 61 to coil changing station 64. During the winding operation, wire drawing machine 68 is operated in a normal mode, wire 10 being wound on spool 22 at the normal operating speed of the coil winder. Upon the completion of a predetermined number of sweeps by wire laying roller 9, programmer 66 stops motor 60.

FIGS. 15–18 show several embodiments of the holding and cutting head 15 of manipulator 11. Head 15 comprises in all embodiments an angled or bent member 41 for intercepting wire 10 and pressing it against a clamping surface 42, member 41 being mounted to manipulator arm 13 by a pair of slidable guide rods 38 and 39 which may, for example, be rigid with the plunger of a hydraulic cylinder (not illustrated) controlled by programmer 66. Upon the attainment by manipulator arm 13 of the operating position shown in FIGS. 5 and 6, guide rods 38 and 39 are retracted in the direction of arrow 40 (FIGS. 15–18) into the manipulator arm, whereby wire 10 is clamped between member 41 and surface 42.

Figure 15:
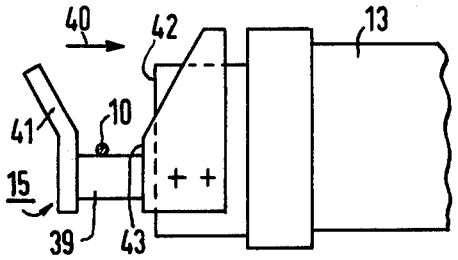
FIG. 15 is a front view on an enlarged scale of a holding and cutting head of the manipulator shown in FIGS. 1–14.
Figure 16:
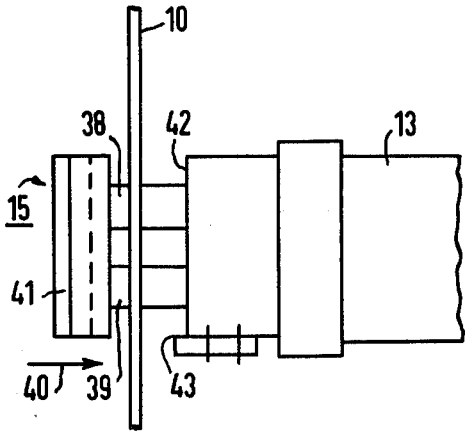
FIG. 16 is a top view corresponding to FIG. 15.
Figure 17:
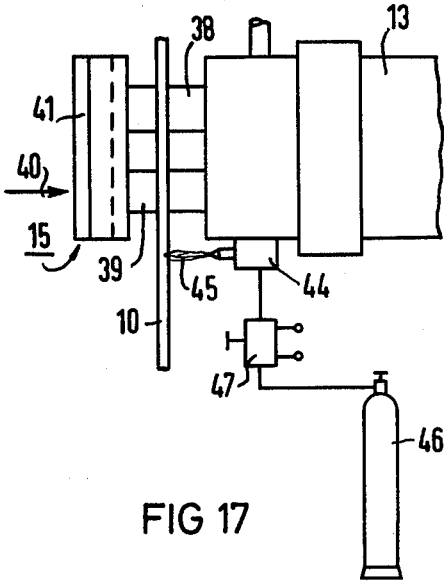
FIG. 17 is a partially schematic top view, similar to FIG. 16, of a modified manipulator head in accordance with this invention.
Figure 18:
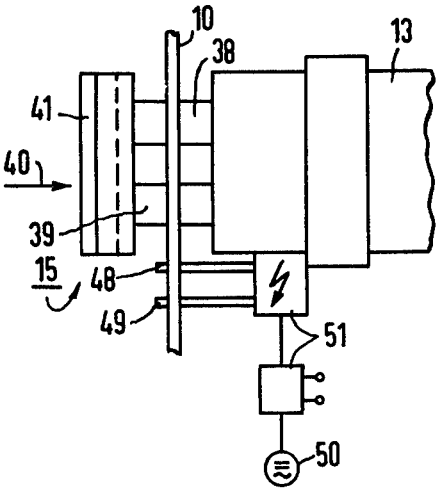
FIG. 18 is a top view similar to FIG. 17, showing another embodiment of the heating and cutting head of the wire manipulator of FIGS. 1–14.

As shown in FIGS. 15 and 16, the severing function of head 15 is implementable by a cutting edge 43 which projects beyond surface 42 and cuts wire 10 while the wire is being clamped to surface 42 by member 41. As illustrated in FIG. 17, wire 10 is advantageously severed by a flame 45 emanating from a cutting torch 44, gas being supplied to the torch from a pressurized source 46 in the form of a bottle or cylinder via a valve 47 automatically operable by programmer 66 (see FIG. 1). In the embodiment of FIG. 18, wire 10 is severed by heat generated through the application of an electric current. Wire 10 is placed in contact, upon clamping at head 15, with a pair of electrodes 48 and 49 connected to a power source 50 via switches 51 actuatable by programmer 66. Upon the closing of switches 51, current flows through the section of wire 10 located between electrodes 48 and 49. The resistance in the wire is such, compared to the resistances in other branches of the circuit, that the heat generated melts the wire. In this way a clean cut is made; the wire ends at the cut are smooth and undamaged.

If wire 10 is particularly hard and thick, severing may be accomplished with a saw or grinding wheel (not illustrated) disposed at the end of an enlarged version of manipulator arm 13. Furthermore, individual operating positions of holding and cutting head 15 may be approached exclusively by linear motions or via arcuate paths or tracks.

What is claimed is:

1. In an individual coil winding apparatus for winding a string-like material on a coil form having two lateral flanges, said coil winding apparatus including clamping means for holding said coil form at a winding station during a winding operation, said clamping means in part forming a closable clamping gap substantially juxtaposed to said coil form at said winding station for receiving an end segment of said string-like material prior to said winding operation and holding said end segment during said winding operation, said coil winding apparatus further including string-dividing means including a manipulator for severing said string-like material and inserting an end segment thereof formed by such severing into said clamping gap between successive winding operations, the improvement wherein said manipulator comprises:

a support post spaced from the winding station;

an arm pivotably and slidably fastened to said support post; and holding and cutting means on said arm for grasping and severing the string-like material at a point along a segment of said string-like material extending from said winding station to a fully wound coil form upon removal thereof from said winding station at the termination of a winding operation.

2. The improvement defined in claim 1 wherein said holding and cutting means includes a cutting edge.

3. The improvement defined in claim 2 wherein the coil winding apparatus further includes a support frame and said manipulator is removably mounted to said support frame.

4. The improvement defined in claim 3 wherein said coil winding apparatus further includes conveyor means, at least in part disposed at a coil changing station spaced from said winding station, for replacing a fully wound coil form with an empty coil form between successive winding operations, said manipulator further comprising a base member to which said support plate is slidably secured for motion substantially between said stations and substantially parallel to a segment of said string-like material extending from said winding station to said coil changing station upon transfer of a fully wound coil form from said winding station to said coil changing station.

5. The improvement defined in claim 4 wherein said coil winding apparatus further includes securing means for detachably fastening a tail section of said string-like material to a coil thereof continuous with said tail section upon transfer to said coil changing station of a coil form bearing such coil, said securing means being supported by said manipulator.

6. The improvement defined in claim 1 wherein said holding and cutting means severs said string-like material by generating heat energy.

7. The improvement defined in claim 3 wherein the ooil winding apparatus further includes a support frame and said manipulator is removably mounted to said support frame.

8. The improvement defined in claim 7 wherein said coil winding apparatus further includes conveyor means, at least in part disposed at a coil changing station spaced from said winding station, for replacing a fully wound coil form with an empty coil form between successive winding operations, said manipulator further comprising a base member to which said support plate is slidably secured for motion substantially between said stations and substantially parallel to a segment of said string-like material extending from said winding station to said coil changing station upon transfer of a fully wound coil form from said winding station to said coil changing station.

9. The improvement defined in claim 8 wherein said coil winding apparatus further includes securing means for detachably fastening a tail section of said string-like material to a coil thereof continuous with said tail section upon transfer to said coil changing station of a coil form bearing such coil, said securing means being supported by said manipulator.

10. The improvement defined in claim 6 wherein said holding and cutting means includes a flame generating device juxtaposable to said string-like material.

11. The improvement defined in claim 6 wherein said string-like material is wire and said holding and cutting means includes an electrical circuit connectable to said wire for transmitting sufficient current therethrough to sever said wire.

12. The improvement defined in claim 1 wherein the coil winding apparatus further includes conveyor means, at least in part disposed at a coil changing station spaced from said winding station, for replacing a fully wound coil form with an empty coil form between successive winding operations, said manipulator being positioned substantially between said winding station and said coil changing station.

13. The improvement defined in claim 1 wherein the coil winding apparatus further includes a support frame and said manipulator forms a structural unit with said support frame.

14. The improvement defined in claim 1 wherein the coil winding apparatus further includes a support frame and said manipulator is removably mounted to said support frame.

15. The improvement defined in claim 1 where said manipulator further comprises a base member to which said support post is slidably secured for motion substantially parallel to the segment of said string-like material extending from said winding station to a fully wound coil form upon removal thereof from said winding station at the termination of a winding operation.

16. The improvement defined in claim 1 wherein the coil winding apparatus further includes a source of said string-like material and accumulator means are provided between said source and said winding station for temporarily storing an amount of said string-like material to accommodate a relatively rapid draw thereof upon removal of a fully wound coil form from said winding station.

17. The improvement defined in claim 1 wherein said string-like material is wire and the coil winding apparatus includes a source of wire in the form of a wire drawing machine actuatable to operate in an accelerated mode for accommodating a relatively rapid draw of said wire upon removal of a fully wound coil form from said winding station.

18. The improvement defined in claim 17 wherein said accelerated mode is an inching mode.

19. The improvement defined in claim 1 wherein the coil winding apparatus further includes securing means for detachably fastening a tail section of said string-like material to a coil thereof continuous with said tail section upon removal from said winding station of a coil form bearing such coil, said securing means being supported by said manipulator.

* * * * *